US011078671B2

(12) United States Patent
Allesen

(10) Patent No.: US 11,078,671 B2
(45) Date of Patent: Aug. 3, 2021

(54) MIDDLE FLASHING ASSEMBLY AND A METHOD FOR WEATHER-PROOFING A ROOF WINDOW ARRANGEMENT

(71) Applicant: VKR Holding A/S, Hørsholm (DK)

(72) Inventor: Torben Krogsgaard Allesen, Horsens (DK)

(73) Assignee: VKR Holding A/S

( * ) Notice: Subject to any disclaimer, the term of this patent is extended or adjusted under 35 U.S.C. 154(b) by 0 days.

(21) Appl. No.: 16/737,802

(22) Filed: Jan. 8, 2020

(65) Prior Publication Data

US 2020/0224425 A1 Jul. 16, 2020

(30) Foreign Application Priority Data

Jan. 10, 2019 (DK) ..... PA 2019 70015

(51) Int. Cl.
*E04D 13/147* (2006.01)
*E04D 13/03* (2006.01)

(52) U.S. Cl.
CPC ..... *E04D 13/1475* (2013.01); *E04D 13/0315* (2013.01)

(58) Field of Classification Search
CPC ..... E04D 13/1475; E04D 13/0315
See application file for complete search history.

(56) References Cited

U.S. PATENT DOCUMENTS 2,851,973 A * 9/1958 Lenke ..... E04B 5/46 52/200
4,520,604 A * 6/1985 Halsey ..... E04D 13/031 52/200

(Continued)

FOREIGN PATENT DOCUMENTS

DE 7829553 1/1979
DE 7920893 11/1986

(Continued)

OTHER PUBLICATIONS

Machine generated translation of DE7829553.

(Continued)

*Primary Examiner* — Paola Agudelo
(74) *Attorney, Agent, or Firm* — Merek, Blackmon & Voorhees, LLC

(57) ABSTRACT

A middle flashing assembly for use in a roof window arrangement with a first roof window located above a second roof window when seen in the direction of inclination of the roof structure is disclosed. It comprises a middle flashing member configured for extending between the roof windows and having at least one engagement section configured for engagement with a connector element extending from the first roof window towards the second roof window. It further comprises an edge supporting rail and an edge gasket both extending on the interior side of the middle flashing member in parallel with a longitudinal edge. The edge gasket is located between the middle flashing member and the edge supporting rail in the mounted state. An end section extends beyond the middle flashing member in the length direction for engagement with the connector element. A method for weather-proofing a roof window arrangement is also disclosed.

20 Claims, 4 Drawing Sheets

(56) References Cited

U.S. PATENT DOCUMENTS

Figure 1:
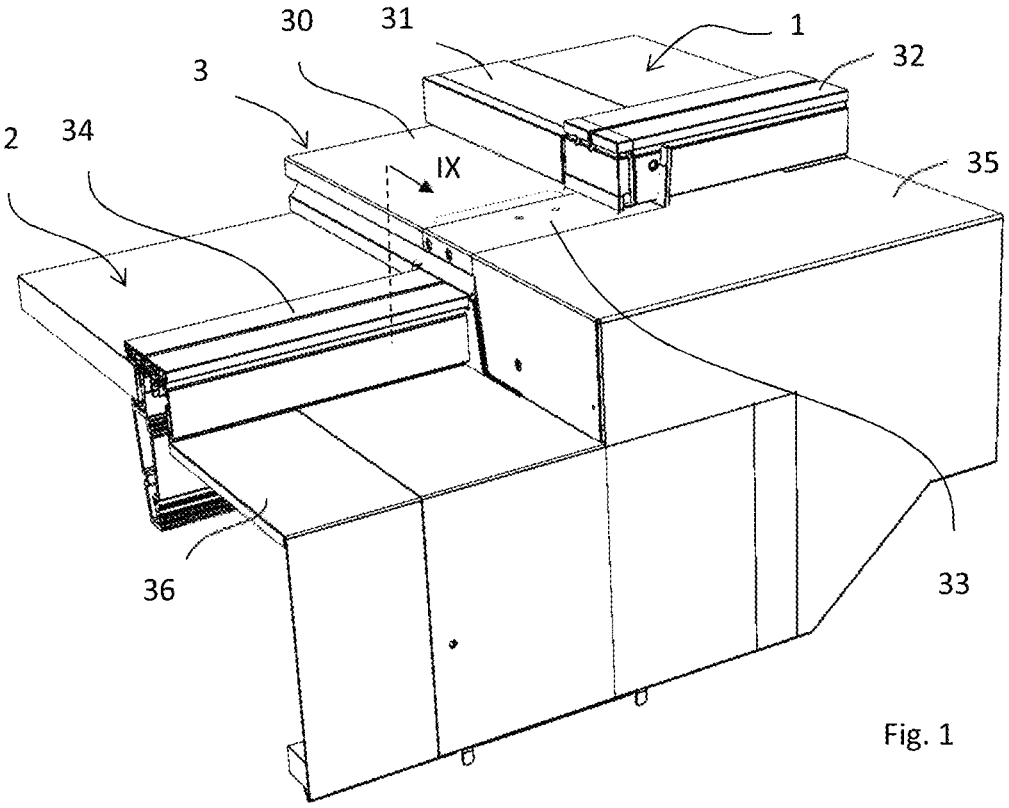

| | | | | |
|---|---|---|---|---|
| 4,570,393 | A * | 2/1986 | Minter | E04D 13/031 49/483.1 |
| 4,621,466 | A * | 11/1986 | Sonneborn | E04D 13/1475 52/15 |
| 4,680,905 | A * | 7/1987 | Rockar | E04D 3/08 52/200 |
| 4,776,141 | A * | 10/1988 | Powell | E04D 13/031 52/200 |
| 5,044,133 | A * | 9/1991 | Sampson | E04D 13/0354 52/72 |
| 5,355,644 | A * | 10/1994 | Guhl | E04D 13/0305 52/200 |
| 6,052,956 | A * | 4/2000 | Hoy | E04D 13/03 52/200 |
| 6,195,948 | B1 * | 3/2001 | Lamanna | E04D 13/0305 52/200 |
| 6,263,623 | B1 * | 7/2001 | Weiss | E04D 13/02 49/463 |
| 7,658,356 | B1 | 2/2010 | Nehls | |
| 9,920,532 | B1 * | 3/2018 | Conklin | E06B 3/6715 |
| 2011/0277402 | A1 * | 11/2011 | Schnitzer | F24S 25/636 52/173.3 |
| 2012/0167483 | A1 * | 7/2012 | Lindgren | E04D 13/0315 52/58 |
| 2014/0305046 | A1 | 10/2014 | Stearns et al. | |
| 2014/0366468 | A1 * | 12/2014 | Lindgren | E06B 1/603 52/200 |
| 2015/0267412 | A1 * | 9/2015 | McClure | E04B 7/02 52/97 |

FOREIGN PATENT DOCUMENTS

| | | |
|---|---|---|
| DE | 20206327 | 7/2002 |
| DE | 202012006688 | 10/2013 |
| DE | 202014000149 | 5/2014 |
| DK | 201670572 | 3/2018 |
| EP | 0087647 | 9/1983 |
| EP | 0428921 | 5/1991 |
| EP | 1533436 | 5/2005 |
| EP | 2472025 | 7/2012 |
| EP | 2472043 | 7/2012 |
| EP | 2752531 | 7/2014 |
| EP | 3039198 | 7/2016 |
| EP | 3252256 | 12/2017 |
| EP | 3282064 | 2/2018 |
| WO | WO 2004/055294 | 7/2004 |
| WO | WO2005/116365 | 12/2005 |
| WO | WO 2015/028032 | 3/2015 |
| WO | WO2015028030 | 3/2015 |

OTHER PUBLICATIONS

Machine generated translation of DE202012006688.

Machine generated translation of DE7920893.

European Search Report dated May 25, 2020, 5 Pages Issued in Connection With European Application No. 20150912 Which is Related to U.S. Appl. No. 16/737,802.

European Extended Search Report dated Jun. 16, 2020, 5 Pages Issued in Connection With European Application No. 20150914 Which is Related to U.S. Appl. No. 16/737,811.

European Extended Search Report dated Apr. 23, 2020, 8 Pages Issued in Connection With European Application No. 20150910 Which is Related to U.S. Appl. No. 16/737,820.

European Extended Search Report dated May 29, 2020, 8 Pages Issued in Connection With European Application No. 20150909 Which is Related to U.S. Appl. No. 16/737,834.

Machine generated translation of DE202014000149.

U.S. Appl. No. 16/737,811, filed Jan. 8, 2020 as entitled "An End Closure for a Cladding for a Roof Window and a Roof Window Arrangement".

U.S. Appl. No. 16/737,820, filed Jan. 8, 2020 as entitled "A Connector Bracket for Interconnecting Roof Windows, a Roof Window Arrangement, and a Method for Mounting at least two Windows in an Inclined Roof Structure".

U.S. Appl. No. 16/737,834, filed Jan. 8, 2020 as entitled "A Connector Element for a Flashing Assembly for use in a Roof Window Arrangement, and a Method for Weather Proofing a Roof Window Arrangement".

Danish Search Report issued in Danish Patent Application No. PA2019 70015 dated Jun. 6, 2019, four pages.

Danish Search Report issued in Danish Patent Application No. PA2019 70016 dated Aug. 27, 2019, four pages.

Danish Search Report issued in Danish Patent Application No. PA2019 70013 dated Jun. 28, 2019, four pages.

Danish Search Report issued in Danish Patent Application No. PA2019 70014 dated Jun. 25, 2019, four pages.

* cited by examiner

MIDDLE FLASHING ASSEMBLY AND A METHOD FOR WEATHER-PROOFING A ROOF WINDOW ARRANGEMENT

The present invention relates to a middle flashing assembly for use in a roof window arrangement mounted in an inclined roof structure and including at least two roof windows each comprising a frame and a pane, where a first roof window is located above a second roof window when seen in the direction of inclination of the roof structure, said middle flashing assembly comprising a middle flashing member comprising a first part and a second part, where the first part is configured for extending between a bottom frame member of the first roof window and a top frame member of the second roof window in the mounted state, said first part having an interior side adapted for facing the interior of a building covered by the roof structure, an exterior side adapted for facing an exterior, a first edge adapted for being located at the first roof window in the mounted state, a second edge adapted for being located at the second roof window and defining a length direction of the middle flashing assembly, and two side edges extending between the first and second edges, where an engagement section configured for engagement with a connector element extending from the frame of the first roof window towards the second roof window is provided at one or both side edges, and where the second part is located on the interior side of the first part, extending from the second edge away from the first part. The invention also relates to a method for weather-proofing a roof window assembly.

Such middle flashing assemblies are known, but it remains a problem to achieve satisfactory weather-proofing of large roof windows mounted in groups, where two or more are mounted in continuation of each other when seen in the direction of inclination of the roof structure. Particularly, it has been a problem to achieve sufficient water-tightness during heavy winds when the inclination of the roof structure is below 25 degrees.

It is therefore the object of the invention to provide a middle flashing assembly, which provides improved tightness to roof window arrangements mounted in roof structures with low inclinations.

In a first aspect of the invention this is achieved with a middle flashing assembly further comprising an edge supporting rail and an edge gasket both extending on the interior side of the middle flashing member in parallel with the second edge in the mounted state, said edge gasket being located between the middle flashing member and the edge supporting rail in the mounted state and having a gasket end section extending beyond the middle flashing member in the length direction, said gasket end section being configured for engagement with the connector element.

The provision of the edge supporting rail provides extra stiffness to the middle flashing assembly along the second edge of the middle flashing member. This prevents or at least reduces sagging, which has especially been seen in very long middle flashing members and potentially also counters lifting of the middle flashing member, which may occur during heavy winds. In this way the middle flashing member is kept in place and the risk of water and wind being able to penetrate into the roof window or roof structure is thus reduced without having to change the middle flashing member itself. This for example allows the use of the same middle flashing member for different installation situations, for example in different climate zones with different wind patterns.

The edge gasket not only ensures a tight connection between the middle flashing member and the edge supporting rail. Its elasticity may also contribute to keeping the middle flashing member in place as described above by keeping a tight contact between the edge supporting rail and the middle flashing member.

The gasket end section extending beyond the middle flashing member in the length direction and being configured for engagement with the connector element not only provides an improved sealing at the end of the middle flashing member. The engagement with both the middle flashing member and the connector element hinders a displacement of the middle flashing member in relation to the connector element, thereby contributing to the tightness of the middle flashing assembly.

In order to provide support for the gasket end section, the edge supporting rail may have a rail end section extending beyond the middle flashing member in the length direction, said rail end section being configured for engagement with the connector element. This also allows for a connection between the connector element and the rail end section, which may provide a more rigid interconnection of the middle flashing member with the connector element.

In order to strengthen the engagement between the connector element and the rail end section and/or the gasket end section, one, two or all of them may be provided with at least one attachment element. The attachment elements may for example be a projection on the connector element matching an opening in the end section or vice versa.

In one embodiment the rail end section is shorter than the gasket end section, so that it projects further from the side edge of the middle flashing member. In this way the edge gasket projects over the end of the edge supporting rail and thus efficiently prevents direct contact between the edge supporting rail and the middle flashing member. It is presently preferred that the gasket end section is configured to extend across the entire width of the connector element, thus also sealing between the connector element and a flashing member covering it, and thus providing a continuous sealing across the width of the roof window.

If the roof windows are mounted in a group, where they are mounted side-by-side in addition to one above the other, a gasket end section extending relatively far from the middle flashing member may reach over to meet or even overlap with a similar edge gasket on a neighbouring roof window.

The edge supporting rail may in principle have any elongate shape allowing it to extend in the length direction of the middle flashing assembly, but in one embodiment it has L-shaped cross-section, where a first leg of the L extends in parallel with the first part of the middle flashing member in the mounted state and the second leg of the L extends in parallel with the second part of the middle flashing member. This shape not only provides good torsional strength, it also contributes to correct mounting of the middle flashing member as the corner of the L-shape, where the two legs meet, will fit into the bend where the two parts of the middle flashing member meet. By pushing the middle flashing member into tight contact with both legs of the L-shape, it will be ensured that it has reached its intended position, and unintentional rotation of the middle flashing member about its length direction will be substantially prevented.

The edge gasket too may have an L-shaped cross-section, where a first leg of the L extends in parallel with the first part of the middle flashing member in the mounted state and the second leg of the L extends in parallel with the second part of the middle flashing member. In a preferred embodiment, however, it has an S-shaped cross-section where the upper part of the S is adapted for hooking over the L-shape of the edge supporting rail while the lower part of the S fits into a hollow between the edge supporting rail and a cover member positioned below it. In this way the edge gasket too fits into and stabilizes the bend on the middle flashing member and the lower part overlaps the joint between the edge supporting rail and cover member, thus weather proofing this joint.

The connector element may form part of the middle flashing assembly.

In one embodiment the connector element is configured for being arranged with an exterior side facing the exterior in the mounted state, an interior side facing the roof structure, a first end facing the first roof window, and a length direction of the connector element extending from the first end towards a second opposite open end, where the exterior side comprises a gutter with two longitudinal edges extending between the first and second ends, at least one of said longitudinal edges being configured for engagement with an engagement section of a flashing member, where a connecting section on the interior side is configured for being connected to a bracket used for connecting a roof window to a load-bearing structure of the roof structure, and where the connector element is configured for being arranged with the first end at an outer side of a bottom frame member of the first roof window, said outer side being substantially perpendicular to the exterior side, and the second end at the second roof window.

In this case an attachment element adapted for engagement with the edge supporting rail and/or the edge gasket is preferably provided on an end surface at the second end of the connector element, which end surface extends from the exterior side towards the interior side in a direction, which is non-parallel to the length direction. If the connector element is substantially symmetrical and has two longitudinal edges both intended for engagement with an engagement section of a flashing member, the end surface is preferably provided with two attachment elements, one at each side. In use, an edge supporting rail may be attached to each of these attachment elements, or a different supporting element adapted for example for supporting a side flashing member may be attached to one of them. In any case, an edge gasket may extend over both attachment elements, possibly being attached to them, so that both edge supporting rails or the edge supporting rail and the different supporting element are covered or overlapped by the edge gasket.

The edge supporting rail as well as other supporting elements is preferably made from a dimensionally stable material, such as aluminium, a high-density polymer, and/or a thermoplastic resin, and will typically be made from moulding, possibly moulding two or more parts separately and interconnecting them afterwards. At present, aluminium is considered to be the most promising material for the edge supporting rail, but is opting for a polymer Xenoy, which is a blend of polycarbonate (PC) and polybutylene terephthalate (PBT), can be used. Alternative materials are acrylonitrile styrene acrylate (ASA), polyamid (PA), specifically PA 6 with a UV stabilizer, and acrylonitrile butadiene styrene (ABS). In most cases it will be advantageous to add an UV stabilizer, which increases the resistance of the material to ultra-violet radiation, and/or an additive increasing the temperature resistance of the material, specifically making the material better suited for use at temperatures below 0 degrees Celcius. Combinations of materials and composites, where for example a metal or a fibrous material is used for reinforcing a polymer, may also be employed.

The edge gasket is made from an elastic material, such as rubber. At present ethylene propylene diene monomer (EPDM) is preferred as it provides a good combination of resistance to ultra violet radiation, temperature and mechanical wear. A vulcanized thermoplastic elastomer (TPV) or another elastomer may, however, also be used. In one embodiment a vulcanised ethylene propylene diene monomer (EPDM) in a matrix of polypropylene (PP) is used. Such a product is sold under the name Santoprene TPV 121-85. Most types of elastomers and particularly thermoplastic elastomers (TPE) may in principle be used, but a relatively high resistance to ultraviolet radiation is required. Fibers or inlays may be used for reinforcing the edge gasket, possibly giving different parts of the end gasket different physical properties such as different elasticity.

In a second aspect of the invention the object is achieved with a method for weather-proofing a roof window arrangement mounted in an inclined roof structure and including at least two roof windows each comprising a frame and a pane, where a first roof window is located above a second roof window when seen in the direction of inclination of the roof structure, said method comprising the following steps:

arranging a middle flashing member with a first part extending between a bottom frame member of the first roof window and a top frame member of the second roof window, said first part having an interior side facing the interior of a building covered by the roof structure, an exterior side facing an exterior, a first edge located at the first roof window, a second edge located at the second roof window and defining a length direction of the middle flashing assembly, and two side edges extending between the first and second edges, and with an engagement section at one or both side edges in engagement with a connector element extending from the frame of the first roof window towards the second roof window, and with a second part on the interior side of the first part extending from the second edge away from the first part, arranging an edge supporting rail on the interior side of the middle flashing member in parallel with the second edge, arranging an edge gasket on the interior side of the middle flashing member in parallel with the second edge so that it is located between the middle flashing member and the edge supporting rail and so that a gasket end section extends beyond the middle flashing member in the length direction, and so that said gasket end section is in engagement with the connector element.

The steps of the method need not be performed in the order mentioned above. On the contrary, it is presently considered advantageous to first apply the edge supporting rail, then the edge gasket, and then the middle flashing member.

Embodiments and advantages described with reference to one aspect of the invention also applies to the other aspects of the invention unless otherwise stated.

Figure 2:
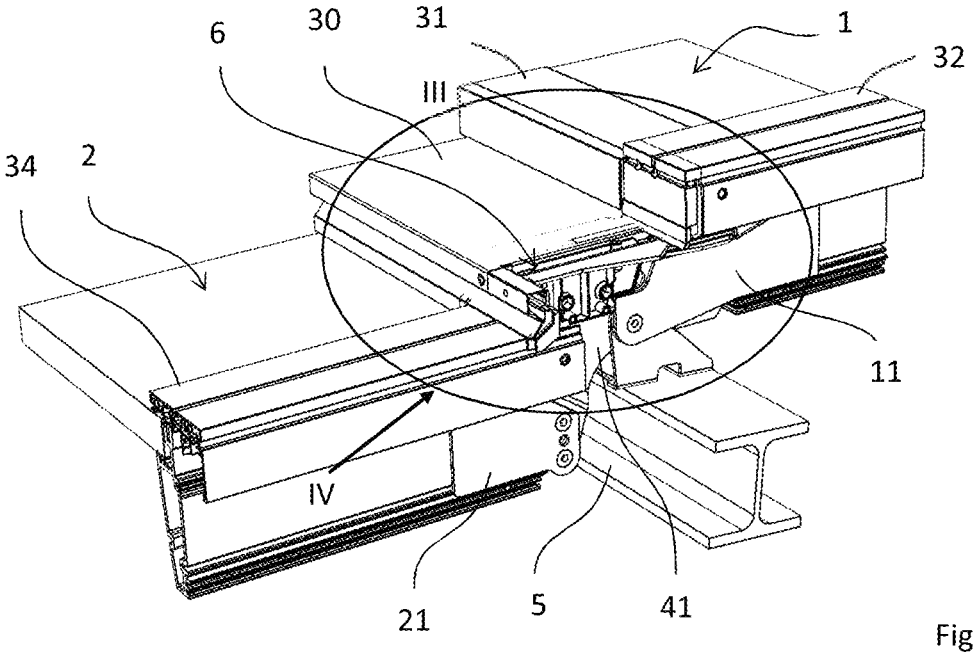
Figure 3:
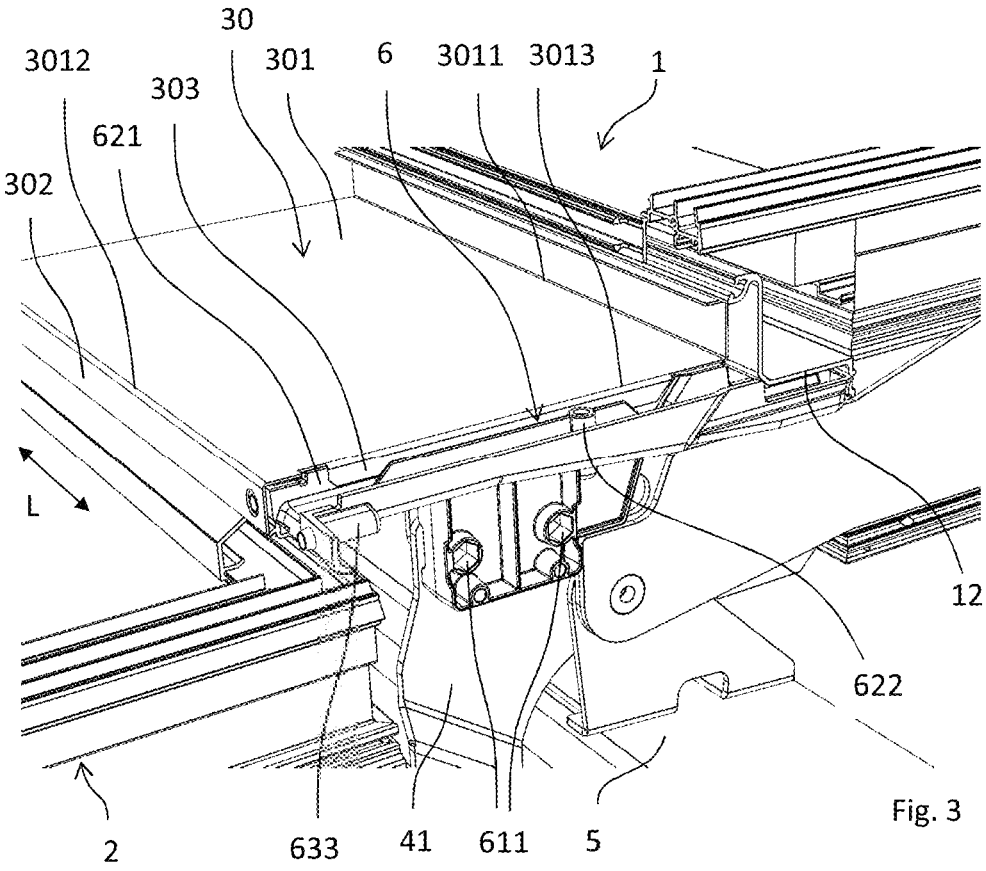
Figure 7:
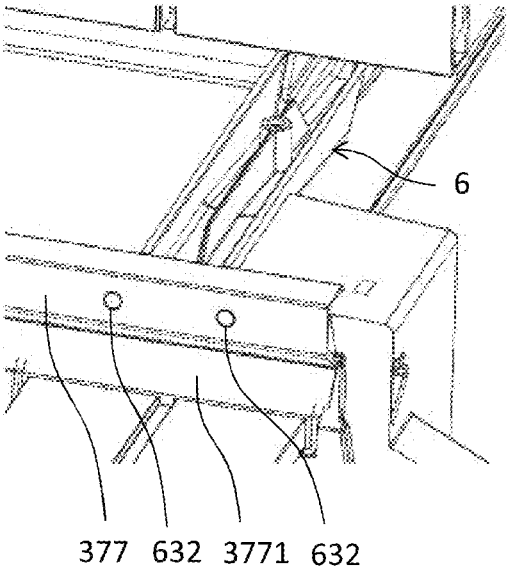
Figure 8:
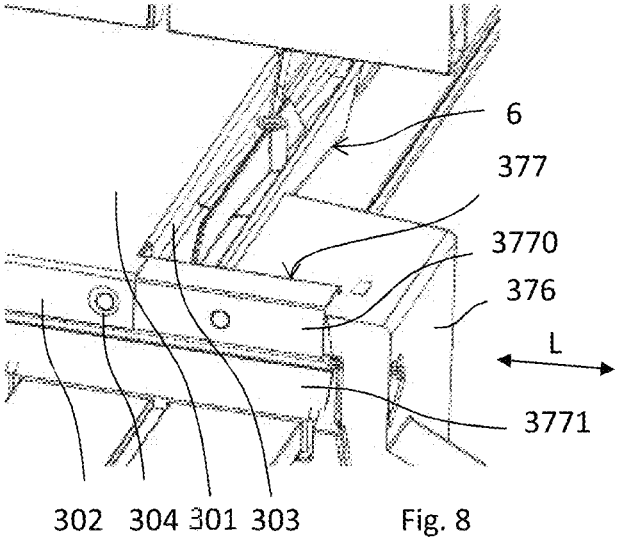
Figure 9:
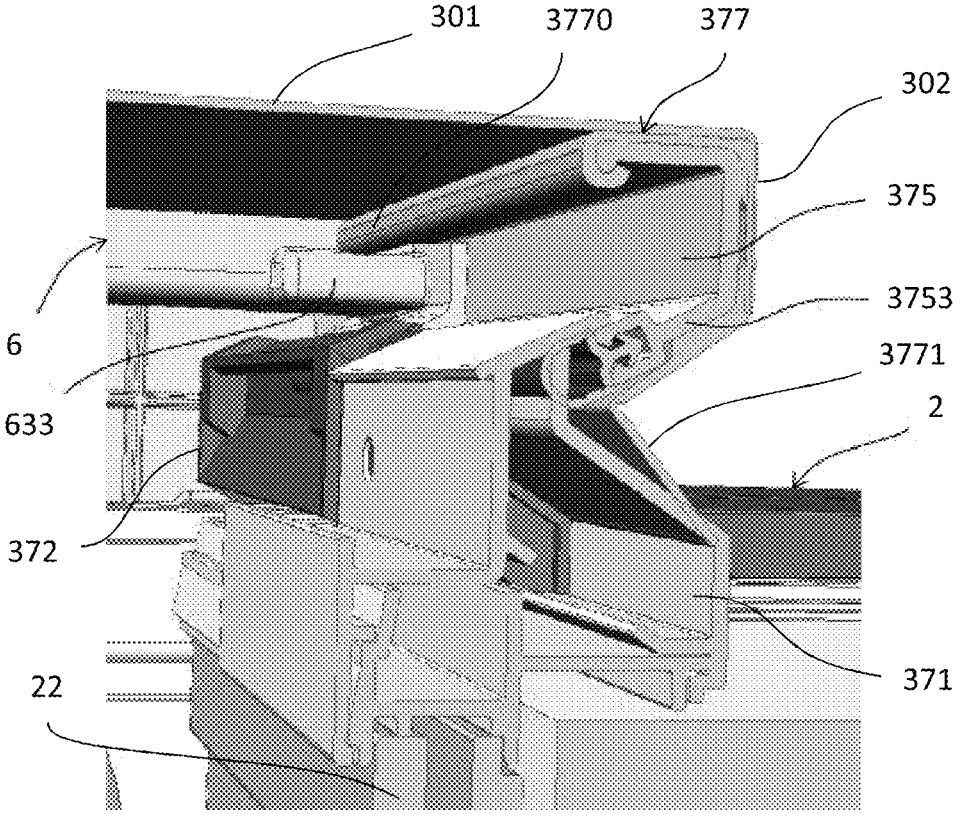
Figure 10:
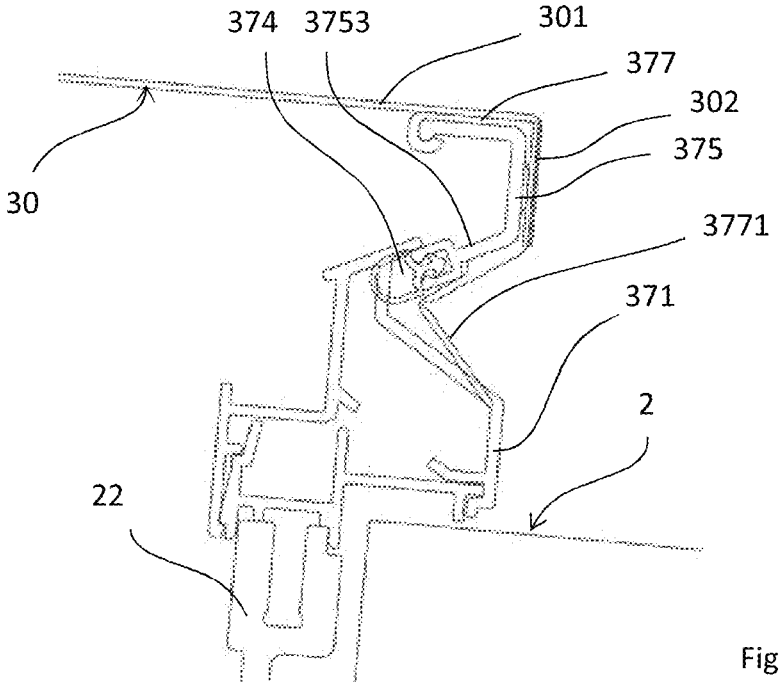

In the following the invention will be described in more detail with reference to the non-limiting embodiments shown in the drawing, where:

FIG. 1 is a perspective partially cut-away view of a roof window arrangement according to the invention, FIG. 2 corresponds to FIG. 1 but with some of the flashing members removed, FIG. 3 shows the detail marked III in FIG. 2, where covering and cladding members of the flashing assembly have been removed, FIGS. 4-8 are perspective views of different stages of the mounting of a middle flashing assembly, each view corresponding substantially to the view in FIG. 3, but seen from a different angle, FIG. 9 is a perspective cross-section along the line IX in FIG. 1, and FIG. 10 is a simplified cross-section corresponding to FIG. 9, but seen directly from the side and with back-ground items removed.

A roof window arrangement in an inclined roof structure including a first roof window 1 located above a second roof window 2 when seen in the direction of inclination of the roof structure is seen in FIG. 1. In addition to the roof windows, it comprises a flashing assembly 3 which includes a middle flashing member 30 extending between the two roof windows, a bottom covering 31 and a cladding 32 on the first window, a cladding 34 on the second window, and side flashing members 35, 36 at the first and second roof windows, respectively. Furthermore, it includes a connector flashing member 33 extending between the middle flashing member 30 and the side flashing member 35 of the first roof window 1 and between the claddings 32, 34 on the two windows.

As is seen in FIG. 2, where side flashing members 35, 36 and the connector flashing member 33 has been removed, the connector flashing member 33 covers a connector element 6, which is attached to a connector bracket 41 interconnecting the mounting brackets 11,21 of the two roof windows 1,2. The attachment of the connector element to the connector bracket may for example be achieved by passing bolts through openings 611 (shown in FIG. 3) in the connector element and through similar aligned openings in the connector bracket.

In FIG. 3, where the bottom covering 31 and the claddings 32,34 have also been removed, the detail marked III in FIG. 2 is seen more clearly.

The middle flashing member 30 comprises a first part 301 having a first edge 3011 located at the first roof window 1 and a second edge 3012 located at the second roof window 2. The middle flashing member thus extends between a bottom frame member 12 of the first roof window 1 and a top frame member (not visible in FIG. 3) of the second roof window 2.

The extend of the second edge 3012 defines a length direction L of the middle flashing assembly.

The middle flashing member 30 further comprises two side edges extending between the first and second edges 3011, 3012. Only one 3013 is seen in FIGS. 1-3 and this side edge has a bent edge 303 serving as an engagement section, which projects into the gutter on the exterior side of the connector element 6. This engagement with the flange 621 defining the longitudinal edges of the gutter prevents the middle flashing member from moving away from the connector element and from moving towards the interior. When the connector flashing member 33 is mounted on top and attached to the tubular attachment element 622, for example by means of a screw, the middle flashing member is further prevented from moving towards the exterior.

Turning now to FIGS. 4-8 an example of the mounting of a flashing assembly by means of a connector element according to the invention is shown.

Figure 4:
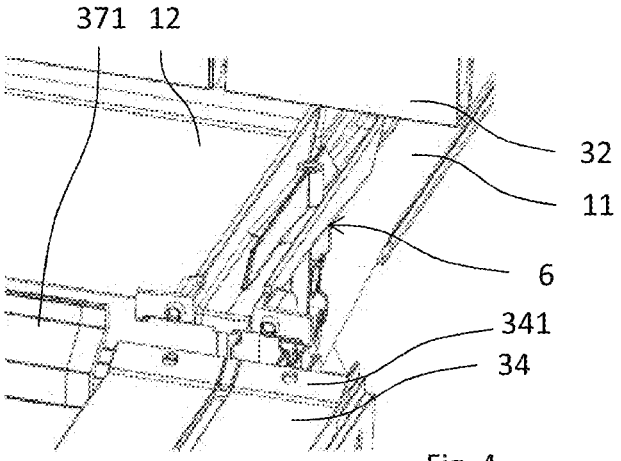

FIG. 4 shows the connector element 6 mounted on the connector bracket (not visible) as in FIG. 2 and extending between the cladding 32 of the first roof window and the cladding 34 of the second roof window. The mounting bracket 11 and frame 12 of the first roof windows is seen in the background and a cover rail 371 is attached to the top frame member (not visible) of the second roof window.

Figure 5:
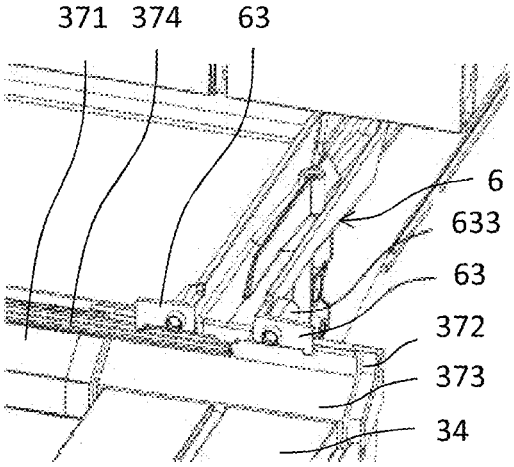

In FIG. 5 a supporting element 372 has been attached to the top corner of the frame of the second roof window so that is supports the upper end 341 of the cladding 34 and a cover member 373 has been arranged on the exterior side of the cladding 34, so that the upper end 341 is sandwiched between the two. Furthermore, a cover gasket 374 extends along the exterior edge of the cover rail 371 and has a length so that it overlaps with the cover member 373 on the cladding 34. Both the cover member 373 and the cover gasket 374 may be arranged behind attachment sections 63 of the connector element 6 so that they are prevented from moving away from the first roof window.

Figure 6:
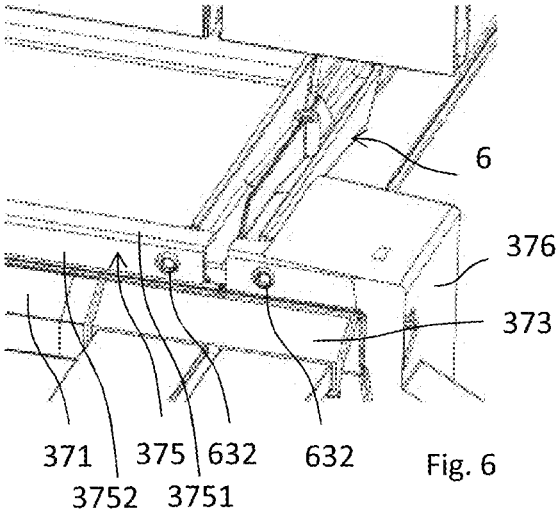

In FIG. 6 an edge supporting rail 375 has been arranged on one side of the connector element 6 on top of the cover gasket 374 and a side flashing supporting element 376 has been arranged on the other side of the connector element overlapping the cladding support element 372 and the cover member 373. Both the edge supporting rail 375 and the side flashing supporting element 376 are provided with circular openings which have been fitted over the attachment elements 632 of the connector element 6 so that the attachment elements project through the openings.

The edge supporting rail 375 has an L-shaped cross-sectional shape and is arranged with a first leg 3751 of the L extends extending towards the first roof window and the second leg 3752 extending downwards towards the cover rail 371.

In FIG. 7 an edge gasket 377 has been attached to both attachment elements 632 by two openings in the edge gasket fitting over them, so that the edge gasket 377 overlaps the gap between the edge supporting rail 375 and the side flashing supporting element 376. The outer ends of the attachment elements 632 are substantially flush with the outer side of the edge gasket 377.

The edge gasket 377 has an S-shaped cross-section where an upper part of the S hooks over the edge supporting rail 375, while a lower part overlaps the cover rail 371, thus weather-proofing the joint between the edge supporting rail and the cover rail.

In FIG. 8 the middle flashing member 30 has been arranged with the bent edge 301 projecting into the gutter of the connector element 6 as described above and with the second part 302 hooking over the edge supporting rail 375 and the edge gasket 377. The system of rails 371,375 and gaskets 374,377 thus provides a weather-proof connection between the middle flashing member 30 and the second roof window. As is seen, the end section 3770 of the edge gasket 377 extends beyond the middle flashing member in the length direction L.

The middle flashing element 30 too has an opening 304, which in the correctly mounted state is aligned with the left-hand attachment element 632 on the connector element 6. A screw or like fastener (not shown) may be passed through this opening 304 and directly into the elongate receiver 633 of the connector element 6. It is, however, also possible to make the attachment element 632 slightly bigger, so that it also projects through the opening 304 in the middle flashing element, and it may even be provided with barb-like projections (not shown) allowing it to snap out on the outer side of the second part 302 of the middle flashing member.

The side flashing member 35 (shown only in FIG. 1) is provided with a similar opening fitting with the right-hand attachment element 632 and corresponding elongate receiver 633, and the connector flashing member 33 has two openings matching the position of the attachment elements 632 in the same way as described for the second gasket 377. This means that when the connector flashing member 33 has been arranged on top of the middle flashing member 30 and the side flashing member 35, two screws or like fasteners passed through all of the aligned openings are sufficient for securing all three flashing members, the supporting elements, and the gaskets to the connector element 6 and thus indirectly to the load-bearing structure. This provides for a simple, reliable, and cost-efficient attachment of the flashing assembly, and the resilience of the edge gasket may help maintain a tight connection between the connector element 6 and the flashing members 30, 33, 35.

The shape and the position of the edge supporting rail 375 and the edge gasket 377 in relation to the other parts of the roof window assembly is seen more clearly in FIGS. 9 and 10.

Specifically, it is seen that edge supporting rail 375 has a third leg 3753, which extends from the L-shape described above and the cover gasket 374 is attached to this leg by an engagement section of the cover gasket being inserted in a groove at the end of the third leg. The cover gasket 374 is here shown in its uncompressed state, but is will be understood that it will be deformed by the contact with the cover rail 371 in the mounted state.

The cover rail 371 is here composed of three interconnected aluminium profiles, one of which is attached to the top frame member 22 of the second roof window, but it may be embodied differently.

The edge gasket 377 too is shown in its uncompressed state. In the mounted state the section of the lower part 3771, which is here illustrated as coinciding with the cover rail 371, will be pressed slightly upwards in the mounted state so that it abuts on the outer surface of the cover rail.

As is seen the lower part 3771 of the edge gasket fits into a hollow formed by the inwards bend on the cover rail 371 and the inclination of the third leg 3753 of the edge supporting rail 375. This in combination with the tight contact between the lower part 3771 of the edge gasket and the cover rail 371 caused by the elasticity of the edge gasket 377 means that water will be kept away from the joint between the cover rail 371 and the edge supporting rail 375. In this embodiment a weakening in the form of a reduced material thickness defines the bend on the lower part of the edge gasket 377, but the S-shape could also be achieved in other ways.

LIST OF REFERENCE NUMBERS

1 First roof windows
11 Mounting bracket
12 Bottom frame member
2 Second roof window
21 Mounting bracket
3 Flashing assembly
30 Middle flashing member
301 First part
3011 First edge
3012 Second edge
3013 Side edge
302 Second part
303 Bent edge
304 Opening
31 Bottom covering
32 Cladding
33 Connector flashing member
34 Cladding
35 Side flashing members
36 Side flashing members
371 Cover rail
372 Supporting element
341 Upper end
373 Cover member
374 Cover gasket
375 Edge supporting rail
3751 First leg
3752 Second leg
3753 Third leg
376 Side flashing supporting element
377 Edge gasket
3770 End section
3771 Lower part of edge gasket
41 Connector bracket
6 Connector element
611 Openings
621 Flange
622 Tubular attachment element
63 Attachment section
632 Attachment element
633 Elongate receiver
L Length direction

The invention claimed is:

1. A middle flashing assembly for use in a roof window arrangement mounted in an inclined roof structure and including at least two roof windows each comprising a frame and a pane, where a first roof window is located above a second roof window when seen in a direction of inclination of the inclined roof structure, said middle flashing assembly comprising a middle flashing member comprising a first part and a second part, where the first part is configured for extending between a bottom frame member of the first roof window and a top frame member of the second roof window in a mounted state, said first part having an interior side adapted for facing an interior of a building covered by the inclined roof structure, an exterior side adapted for facing an exterior, a first edge adapted for being located at the first roof window in the mounted state, a second edge adapted for being located at the second roof window and defining a length direction of the middle flashing assembly, and two side edges extending between the first and second edges, where an engagement section of said first part is provided at one or both side edges of said first part, wherein said engagement section of said first part is configured, in the mounted state, to engage a connector element configured, in the mounted state, to extend from the frame of the first roof window towards the second roof window, and where the second part is located on the interior side of the first part, extending from the second edge away from the first part, the middle flashing assembly further comprises an edge supporting rail and an edge gasket both extending on the interior side of the middle flashing member in parallel with the second edge in the mounted state, said edge gasket being located between the middle flashing member and the edge supporting rail in the mounted state and having a gasket end section extending beyond the middle flashing member in the length direction, said gasket end section being configured for engagement with the connector element.

2. The middle flashing assembly according to claim 1, where the edge supporting rail has a rail end section extending beyond the middle flashing member in the length direction, said rail end section being configured for engagement with the connector element.

3. The middle flashing assembly according to claim 2, where the rail end section is shorter than the gasket end section.

4. The middle flashing assembly according to claim 3, where the gasket end section is configured to extend across an entire width of the connector element.

5. The middle flashing assembly according to claim 3, where the rail end section is provided with at least one attachment element, said attachment element being adapted for engagement with the connector element.

6. The middle flashing assembly according to claim 2, where the rail end section is provided with at least one attachment element, said attachment element being adapted for engagement with the connector element.

7. The middle flashing assembly according to claim 6, where the gasket end section is provided with at least one attachment element, said attachment element being adapted for engagement with the connector element.

8. The middle flashing assembly according to claim 7, where the edge supporting rail has an L-shaped cross-section, where a first leg of the L extends in parallel with the first part of the middle flashing member in the mounted state and a second leg of the L extends in parallel with the second part of the middle flashing member.

9. The middle flashing assembly according to claim 8, where the edge gasket has an S-shaped cross-section where an upper part of the S is adapted for hooking over the edge supporting rail while a lower part of the S is adapted for covering a joint between the edge supporting rail and a cover member positioned below the edge supporting rail.

10. The middle flashing assembly according to claim 9, further including a connector element configured for being arranged with an exterior side of the connector element facing the exterior in the mounted state, an interior side of the connector element facing the inclined roof structure, a first end facing the first roof window, and a length direction of the connector element extending from the first end towards a second open end, where the exterior side comprises a gutter with two longitudinal edges extending between the first and second ends, at least one of said longitudinal edges being configured for engagement with the engagement section, where a connecting section on the interior side is configured for being connected to a bracket used for connecting a roof window to a load-bearing structure of the inclined roof structure, and where the connector element is configured for being arranged with the first end of the connector element at an outer side of a bottom frame member of the first roof window and the second end of the connector element at the second roof window.

11. The middle flashing assembly according to claim 2, where the gasket end section is configured to extend across an entire width of the connector element.

12. The middle flashing assembly according to claim 2, where the gasket end section is provided with at least one attachment element, said attachment element being adapted for engagement with the connector element.

13. The middle flashing assembly according to claim 1, where the gasket end section is configured to extend across an entire width of the connector element.

14. The middle flashing assembly according to claim 13, where the rail end section is provided with at least one attachment element, said attachment element being adapted for engagement with the connector element.

15. The middle flashing assembly according to claim 1, where the gasket end section is provided with at least one attachment element, said attachment element being adapted for engagement with the connector element.

16. The middle flashing assembly according to claim 1, where the edge supporting rail has an L-shaped cross-section, where a first leg of the L extends in parallel with the first part of the middle flashing member in the mounted state and a second leg of the L extends in parallel with the second part of the middle flashing member.

17. The middle flashing assembly according to claim 1, where the edge gasket has an S-shaped cross-section where an upper part of the S is adapted for hooking over the edge supporting rail while a lower part of the S is adapted for covering a joint between the edge supporting rail and a cover member positioned below the edge supporting rail.

18. The middle flashing assembly according to claim 1, further including a connector element configured for being arranged with an exterior side of the connector element facing the exterior in the mounted state, an interior side of the connector element facing the inclined roof structure, a first end facing the first roof window, and a length direction of the connector element extending from the first end towards a second open end, where the exterior side comprises a gutter with two longitudinal edges extending between the first and second ends, at least one of said longitudinal edges being configured for engagement with the engagement section, where a connecting section on the interior side is configured for being connected to a bracket used for connecting a roof window to a load-bearing structure of the inclined roof structure, and where the connector element is configured for being arranged with the first end of the connector element at an outer side of a bottom frame member of the first roof window and the second end of the connector element at the second roof window.

19. The middle flashing assembly according to claim 18, where an end surface at the second end of the connector element extending from the exterior side towards the interior side in a direction, which is non-parallel to the length direction, is provided with at least one attachment element, said attachment element being adapted for engagement with the edge supporting rail and/or the edge gasket.

20. A method for weather-proofing a roof window arrangement mounted in an inclined roof structure and including at least two roof windows each comprising a frame and a pane, where a first roof window is located above a second roof window when seen in a direction of inclination of the inclined roof structure, said method comprising the following steps:

arranging a middle flashing member with a first part extending between a bottom frame member of the first roof window and a top frame member of the second roof window, said first part having an interior side facing an interior of a building covered by the inclined roof structure, an exterior side facing an exterior, a first edge located at the first roof window, a second edge located at the second roof window and defining a length direction of the middle flashing assembly, and two side edges extending between the first and second edges, and with an engagement section at one or both side edges in engagement with a connector element extending from the frame of the first roof window towards the second roof window is provided, and with a second part on the interior side of the first part extending from the second edge away from the first part, arranging an edge supporting rail on the interior side of the middle flashing member in parallel with the second edge, arranging an edge gasket on the interior side of the middle flashing member in parallel with the second edge so that the edge gasket is located between the middle flashing member and the edge supporting rail and so that a gasket end section of the edge gasket extends beyond the middle flashing member in the length direction, and so that said gasket end section is in engagement with the connector element.

* * * * *